US006860260B2

(12) United States Patent
Lin

(10) Patent No.: US 6,860,260 B2
(45) Date of Patent: Mar. 1, 2005

(54) BASE SEAT OF PNEUMATIC GRINDER

(75) Inventor: Freddy Lin, Taichung (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 85 days.

(21) Appl. No.: 10/359,648

(22) Filed: Feb. 7, 2003

(65) Prior Publication Data

US 2004/0154602 A1 Aug. 12, 2004

(51) Int. Cl.[7] ..... B28D 1/00; B28D 1/02

(52) U.S. Cl. ..... 125/1; 125/12; 125/13.01; 30/375

(58) Field of Search ..... 30/276, 373, 374, 30/375, 376, 377; 125/1, 12, 13.01, 36, 38

(56) References Cited

U.S. PATENT DOCUMENTS 2,676,624 A * 4/1954 Gecmen ..... 30/373
4,938,201 A * 7/1990 Chiuminatta et al. .... 125/13.01
5,595,170 A * 1/1997 Lupi ..... 125/12
5,784,789 A * 7/1998 Vargas ..... 30/388
6,367,468 B1 * 4/2002 Edwards et al. ..... 125/36

* cited by examiner

*Primary Examiner*—Timothy V. Eley
(74) *Attorney, Agent, or Firm*—Troxell Law Office PLLC

(57) ABSTRACT

Base seat of a pneumatic grinder, including an air way and a water way disposed in the base seat to respectively communicate with an air chamber and a water chamber formed in the base seat. Several water outlets and a predetermined number of air rooms are disposed on a bottom face of the base seat. The water outlets communicate with the water chamber, while the air rooms communicate with the air chamber. Multiple ball bodies are respectively rollably disposed in the air rooms, the bottom edge of the ball bodies protrude from the bottom face of the base seat. When high pressure air and water are conducted into the air way and water way, the air is conducted by the air way to flow into the air chamber and to blow to the ball bodies in the air rooms making the ball bodies rolling easily. The water flows through the water way into the water chamber and then flows through the water outlets out of the bottom face of the base seat to reduce frictional force against the bottom face of the base seat.

20 Claims, 14 Drawing Sheets

BASE SEAT OF PNEUMATIC GRINDER

BACKGROUND OF THE INVENTION

The present invention is related to a pneumatic tool, and more particularly to a base seat of a pneumatic tool, which makes it easy to move the pneumatic tool in operation.

Stone material is conventionally ground with an electric grinder. When grinding the stone material, it is necessary to move the grinder on the stone material. The electric grinder has a considerably large volume and considerable heavy weight. Therefore, it is difficult to operate an electric grinder. Moreover, the base seat of the electric grinder makes it hard to slide the electric grinder.

SUMMARY OF THE INVENTION

It is therefore a primary object of the present invention to provide a base seat of a grinder, especially to a base seat of a pneumatic grinder, which by means of air and water reduces frictional force between the base seat and the stone material. Accordingly, the grinder can be easily operated and moved.

The present invention can be best understood through the following description and accompanying drawings wherein:

DETAILED DESCRIPTION OF THE PREFERRED EMBODIMENTS

Figure 1:
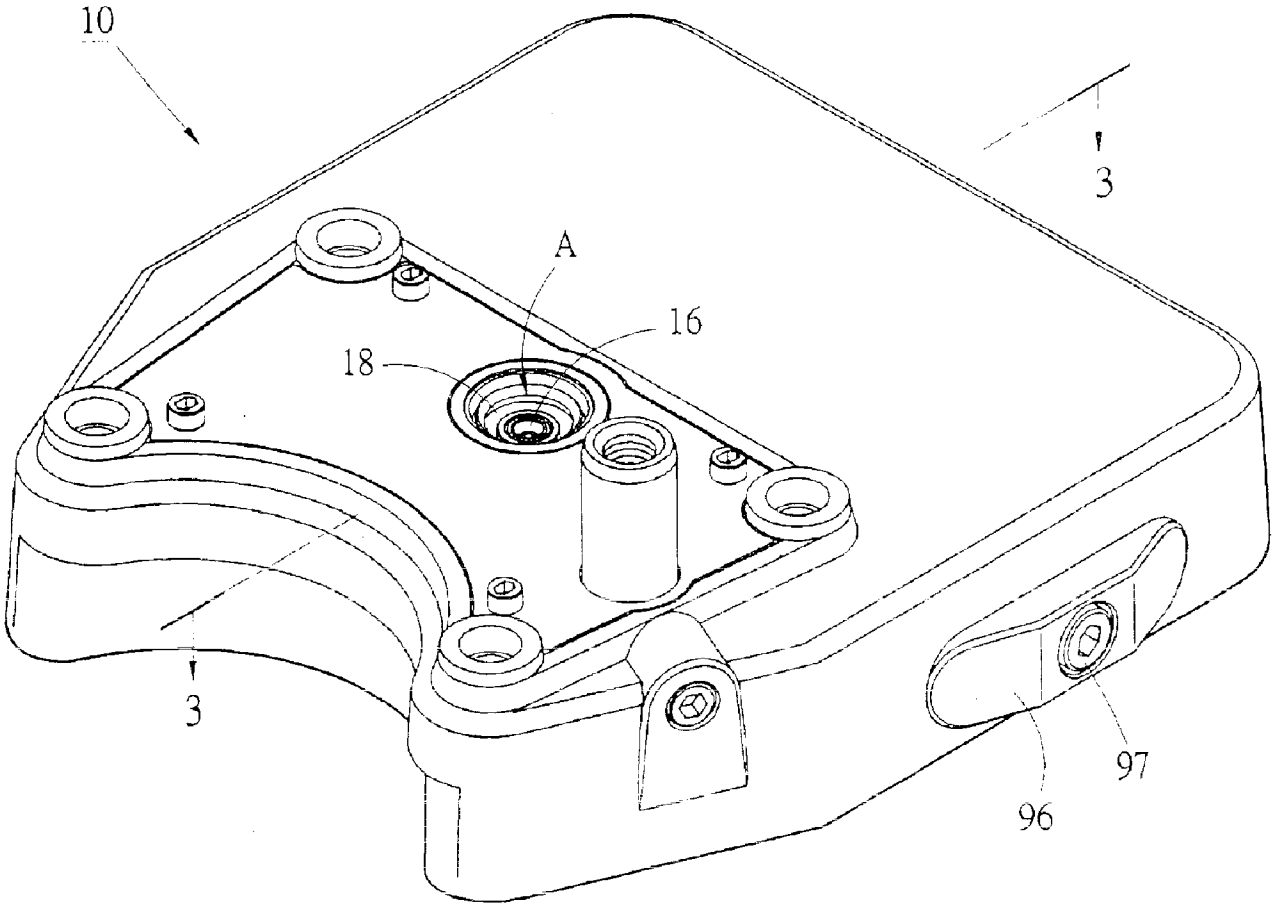
FIG. 1 is a perspective assembled view of a preferred embodiment of the present invention.
Figure 2:
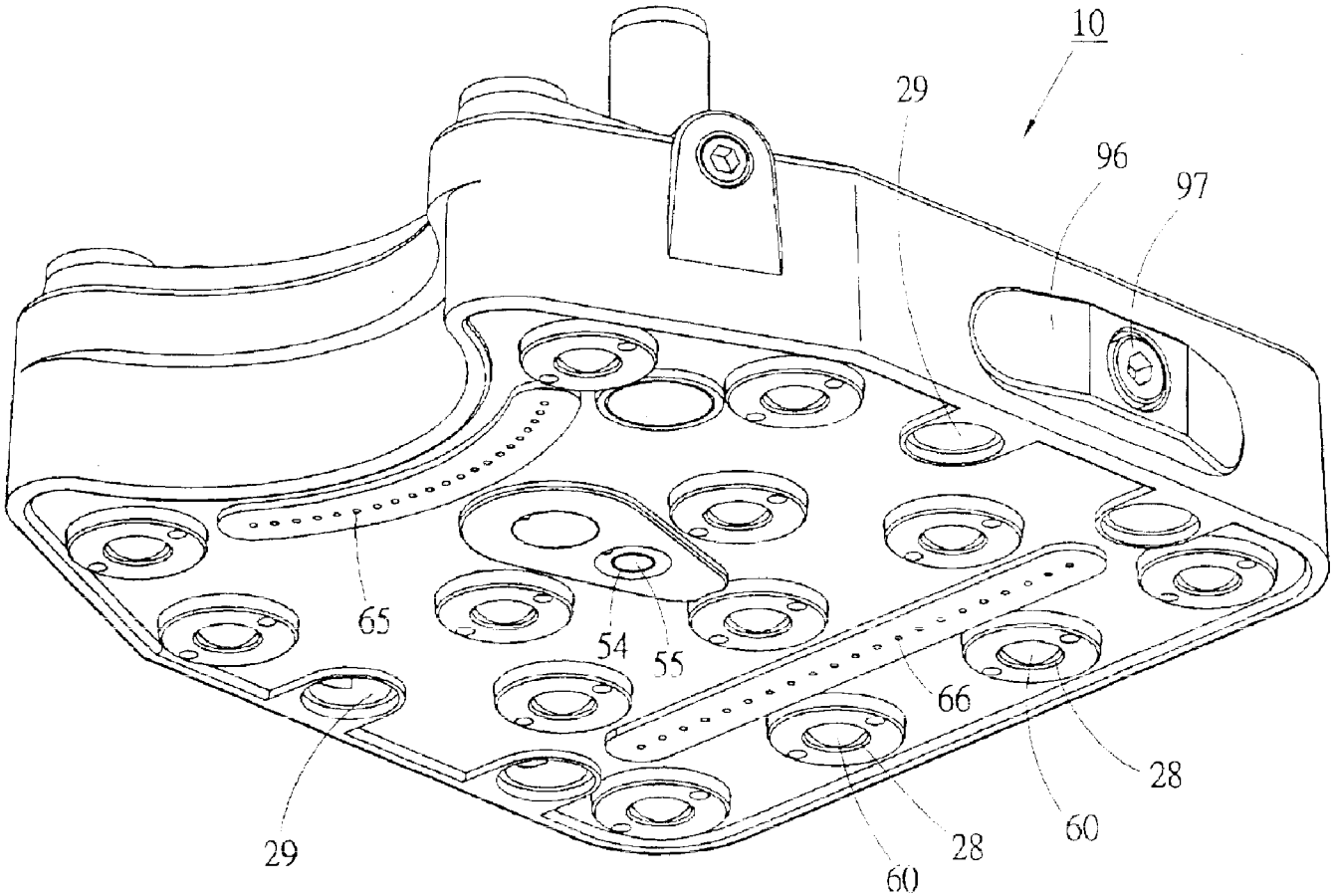
FIG. 2 is a bottom perspective view according to FIG. 1.

Please refer to FIG. 1. The base seat 10 of the pneumatic grinder of the present invention has an internal air way and an internal water way respectively communicating with an air chamber and a water chamber. Referring to FIG. 2, the bottom face of the base seat 10 is formed with several water outlets 65, 66 and ball bodies 60.

An inlet A is formed on top face of the base seat 10. In this embodiment, the inlet is for both air and water. In detail, referring to FIG. 3, the top face of the base seat 10 is recessed to form a hole 12. An inner tube 14 is coaxially disposed in the hole 12. The interior of the hole 12 and the interior of the inner tube 14 form two concentric flow ways 16, 18. The flow way 18 is a part of the air way B, while the flow way 16 is a part of the water way C. The bottom face of the base seat 10 is inward recessed to form a cavity 20 in which a controlling switch 50 is disposed. (This will be described hereafter.)

Figure 3:
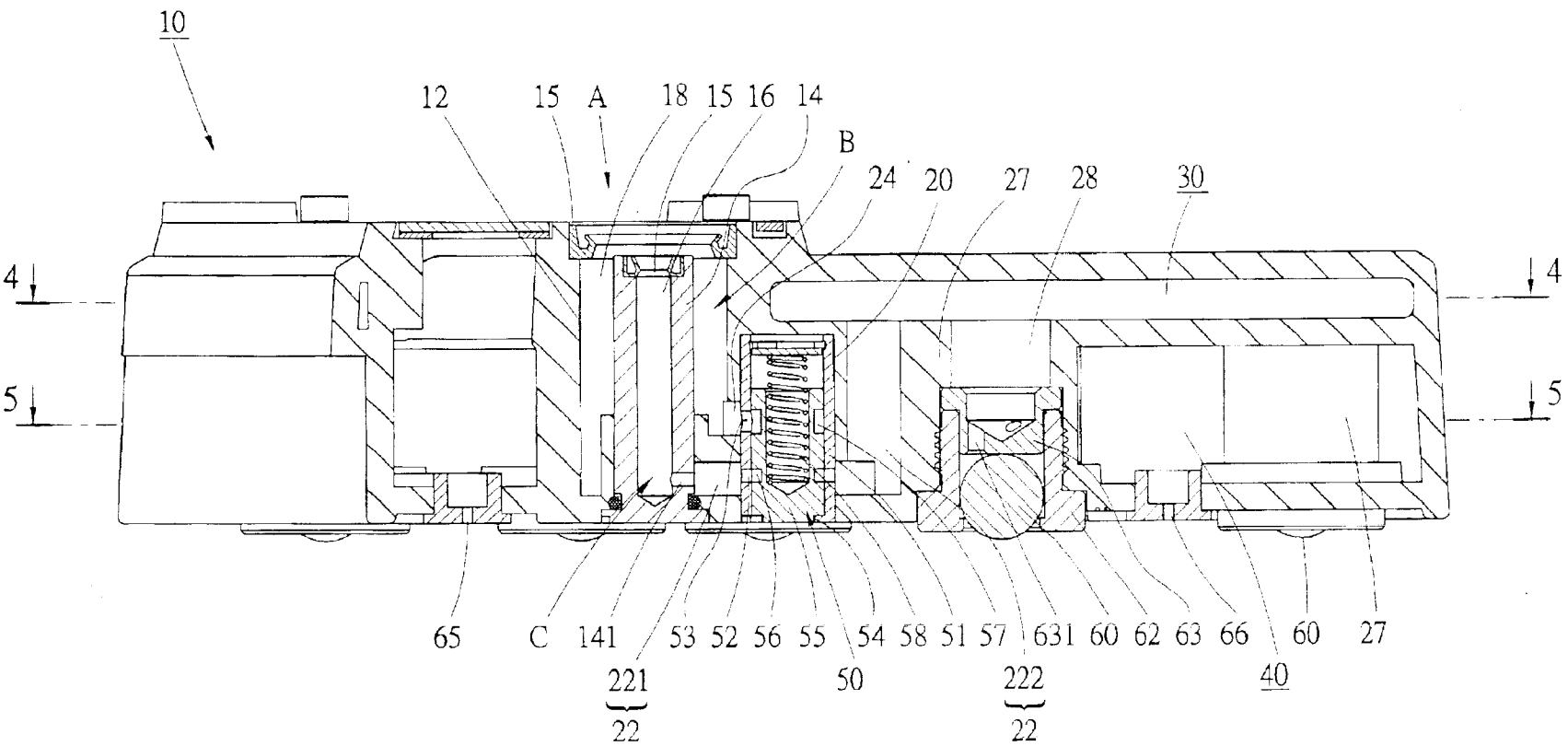
FIG. 3 is a sectional view taken along line 3—3 of FIG. 1.
Figure 4:
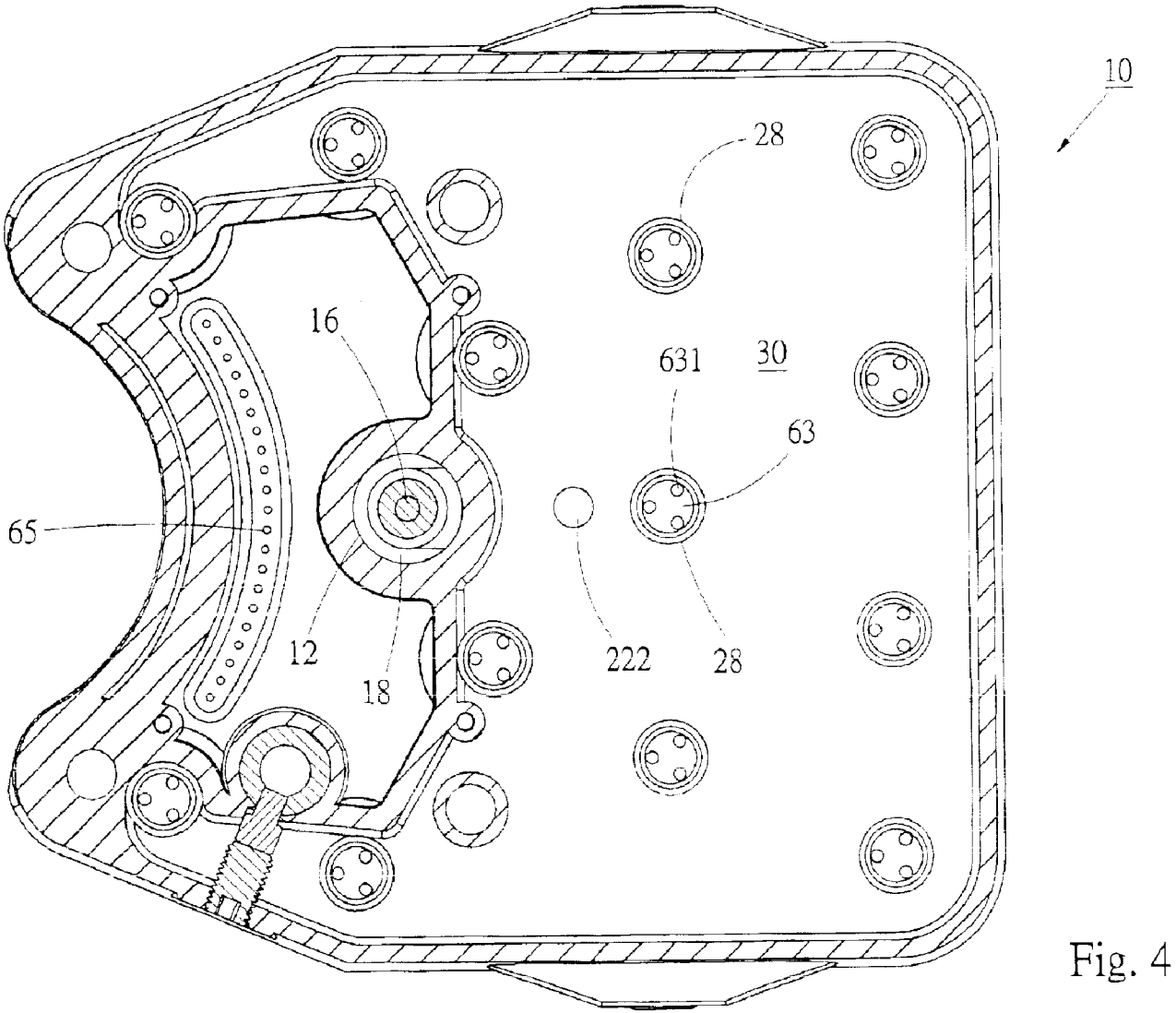
FIG. 4 is a sectional view taken along line 4—4 of FIG. 1.
Figure 5:
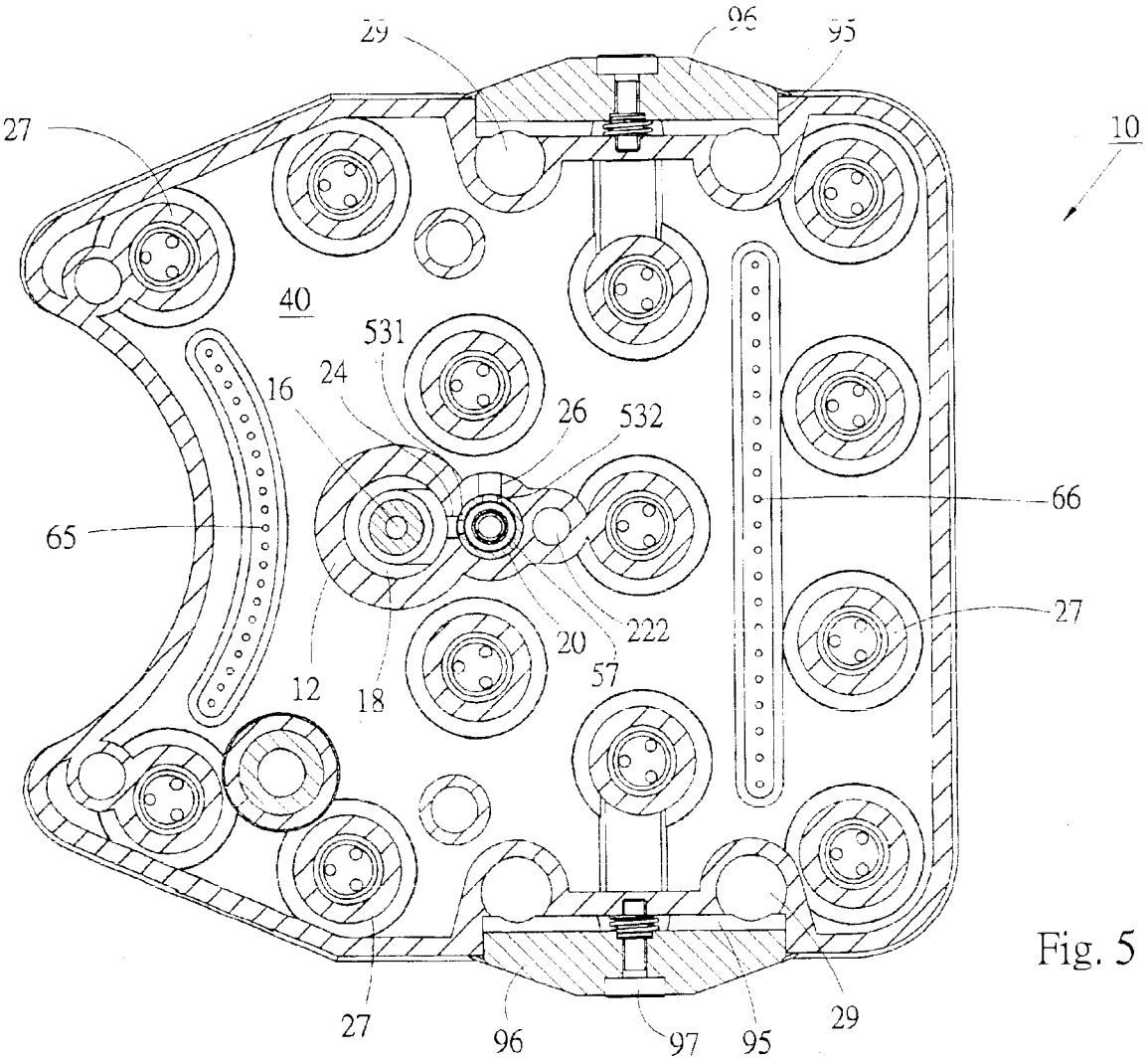
FIG. 5 is a sectional view taken along line 5—5 of FIG. 1.

The air chamber 30 as shown in FIGS. 3 and 4 and the water chamber 40 as shown in FIGS. 3 and 5 are both disposed in the base seat 10. The air chamber 30 is positioned above the water chamber 40.

In addition to the flow way 18, the air way B further includes a small hole 141 and a passage 22. The small hole 141 is formed at bottom end of the inner tube 14. The passage 22 has a horizontal section 221 and an upright section 222 communicating with each other. Two ends of the passage 22 respectively communicate with the small hole 141 and the air chamber 30, whereby the air way B communicates with the air chamber. The horizontal section 221 passes through the cavity 20.

In addition to the flow way 16, the water way C further includes a tunnel 24 and a conducting hole 26. The tunnel 24 communicates with the flow way 16 and the cavity 40. As shown in FIG. 5, the conducting hole 26 communicates with the water chamber 40 from one side of the cavity 20. The conducting hole 26 and the tunnel 24 are positioned at the same height.

Figure 7:
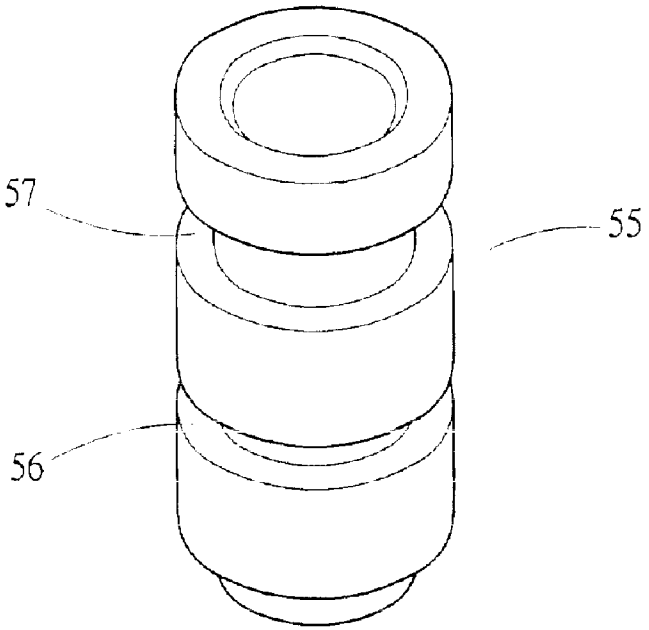
FIG. 7 is a perspective view of the valve of the controlling switch of the present invention.
Figure 6:
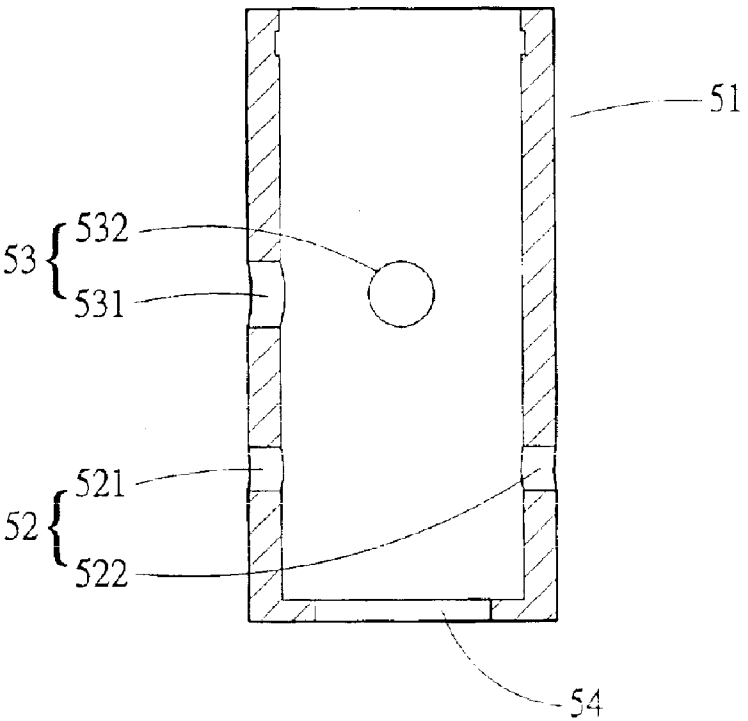
FIG. 6 is a sectional view of the barrel of the controlling switch of the present invention.

Said controlling switch 50 includes a barrel 51 and a valve 55. As shown in FIG. 6, the circumference of the barrel 51 is formed with two through holes 52, 53. The first through hole 52 includes two ports 521, 522 on the circumference of the barrel, which are linearly arranged. The second through hole 53 includes two ports 531, 532 on the circumference of the barrel, which are angularly spaced by 90 degrees. The first through hole 52 communicates with the horizontal section 221 of the passage 22, while the ports 531, 532 of the second through hole 53 respectively communicate with the tunnel 24 and the conducting hole 26. A perforation 54 is formed on the bottom face of the barrel. The valve 55 is up and down movably disposed in the barrel 51. As shown in FIG. 7, two flow conducting sections 56, 57 as annular grooves are formed on the circumference of the valve. The valve is pushed by a spring 58, whereby in normal state, the valve is located at bottom end of the barrel 51. When the valve is positioned at a lower dead end, the first conducting section 56 is aligned with the first through hole 52 to keep the air way B free, while the second conducting section 57 is aligned with the second through hole 53 to keep the water way C free. In addition, the perforation 54 of the barrel is positioned on bottom face of the base seat, whereby the bottom end of the valve 55 is exposed to the bottom face of the base seat and is touchable as shown in FIG. 2.

Thirteen hollow cylinder bodies 27 are integrally formed in the water chamber 40 inside the base seat 10. The cylinder bodies are independently disposed in the water chamber without communicating with the water chamber. Each cylinder body defines therein an air room 28. The top end of the air room 28 communicates with the air chamber 30, while the bottom end of the air room 28 passes through the cylinder body to the bottom face of the base seat.

Thirteen ball bodies 60 are respectively mounted in the air rooms 28. The ball body is located in the air room by means of hollow locating member 62 and spacer ring 63 disposed in the air room. The bottom edge of the ball body 60 protrudes from the bottom face of the base seat 10.

Referring to FIG. 5, a predetermined number of water draining holes, such as two rows of water draining holes 65, 66 are disposed on the bottom walls of front and rear sides of the water chamber 40. The water draining holes pass through the bottom walls to the bottom face of the base seat 10.

Figure 8:
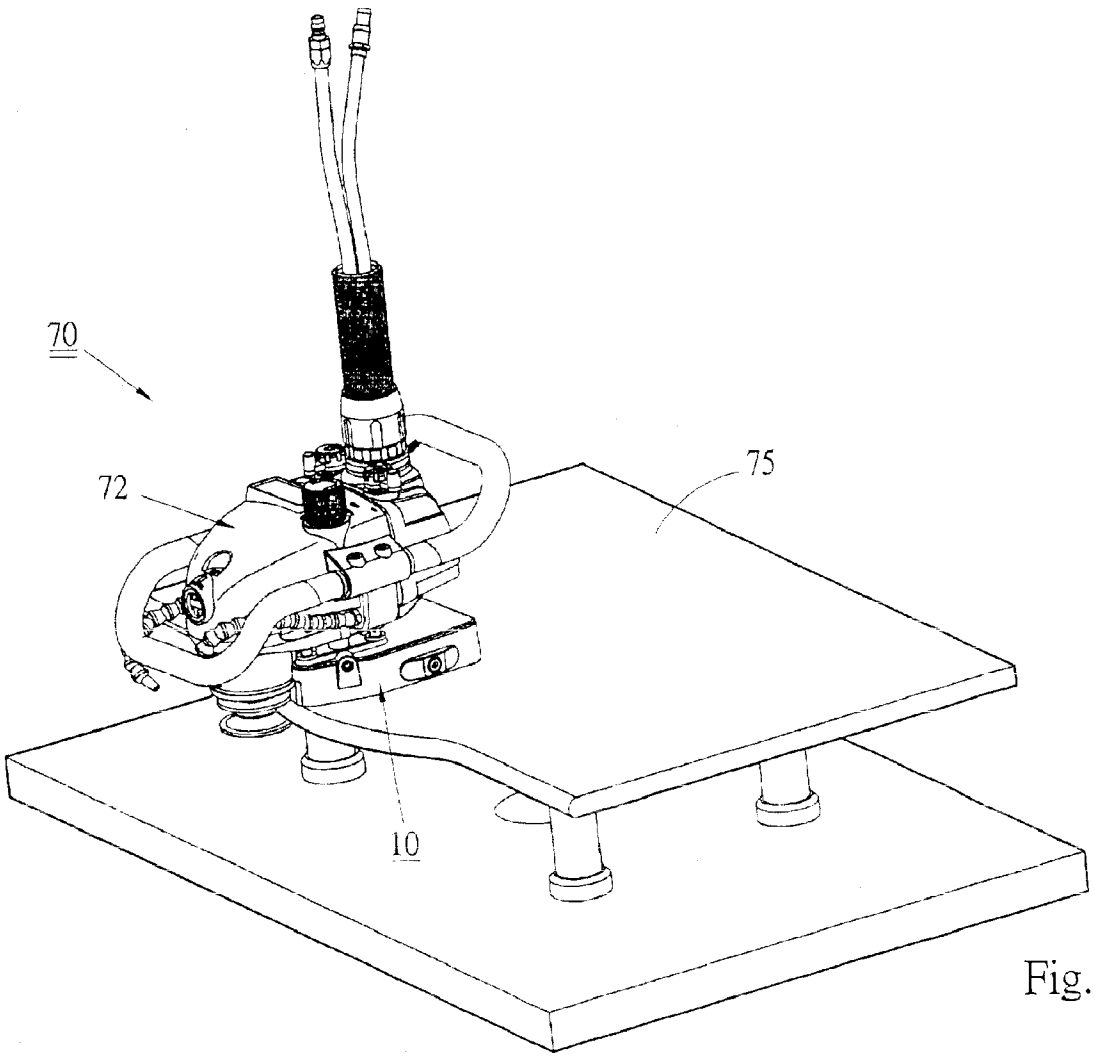
FIG. 8 shows the use of the present invention in one state.

In use of the present invention, the base seat 10 is mounted under the main body 72 of the pneumatic grinder 70, as shown in FIG. 8. Two concentric inner and outer tubes disposed on the bottom face of the main body are inserted in the inlet A for inputting high pressure air and water from the inlet into the base seat. The structure of the main body is described in another application. In operation, the base seat 10 is placed on the top face of the stone material 75 for grinding the stone material. The ball bodies 60 roll on the stone material so as to easily move the base seat.

Referring to FIG. 3, a leakproof ring 15 is disposed at each of top ends of the hole 12 and the inner tube 14 at the inlet A so as to keep the flow way independent.

After the high pressure air is conducted into the flow way 18 of the air way B, the air flows from the small hole 141 into the horizontal section 221 of the passage 22. Then the air flows the first through hole 52 of the barrel 51 of the controlling switch 50 and the first flow conducting section 56 of the valve body 55 into the upright section 222 of the passage to fill into the air chamber 30. Thereafter, the high pressure air flows into the air rooms 28 to blow to the ball bodies 60.

After the high pressure air flows into the air rooms 28, the air flows from the orifices 631 of the spacer rings 63 to the ball bodies 60 to speed the airflow. When the air blows to the ball bodies 60, the ball bodies are suspended in the air rooms 28 (locating members 62) so as to reduce the rolling friction of the ball bodies and facilitate movement of the base seat.

When the water is conducted into the flow way 16 of the water way C, the water flows from the tunnel 24 into the port 531 of the second through hole 53 of the barrel 51 and the second flow conducting section 57 of the valve body 55 and through the port 532 of the second through hole, as shown in FIG. 5, and the conducting hole 26 into the water chamber 40. Then, the water flows from the water draining holes 65, 66 out of the bottom face of the base seat 10. The water is distributed between the bottom face of the base seat and the stone material. This also reduces the frictional resistance between the base seat and the stone material and makes it easy to move the base seat.

Figure 9:
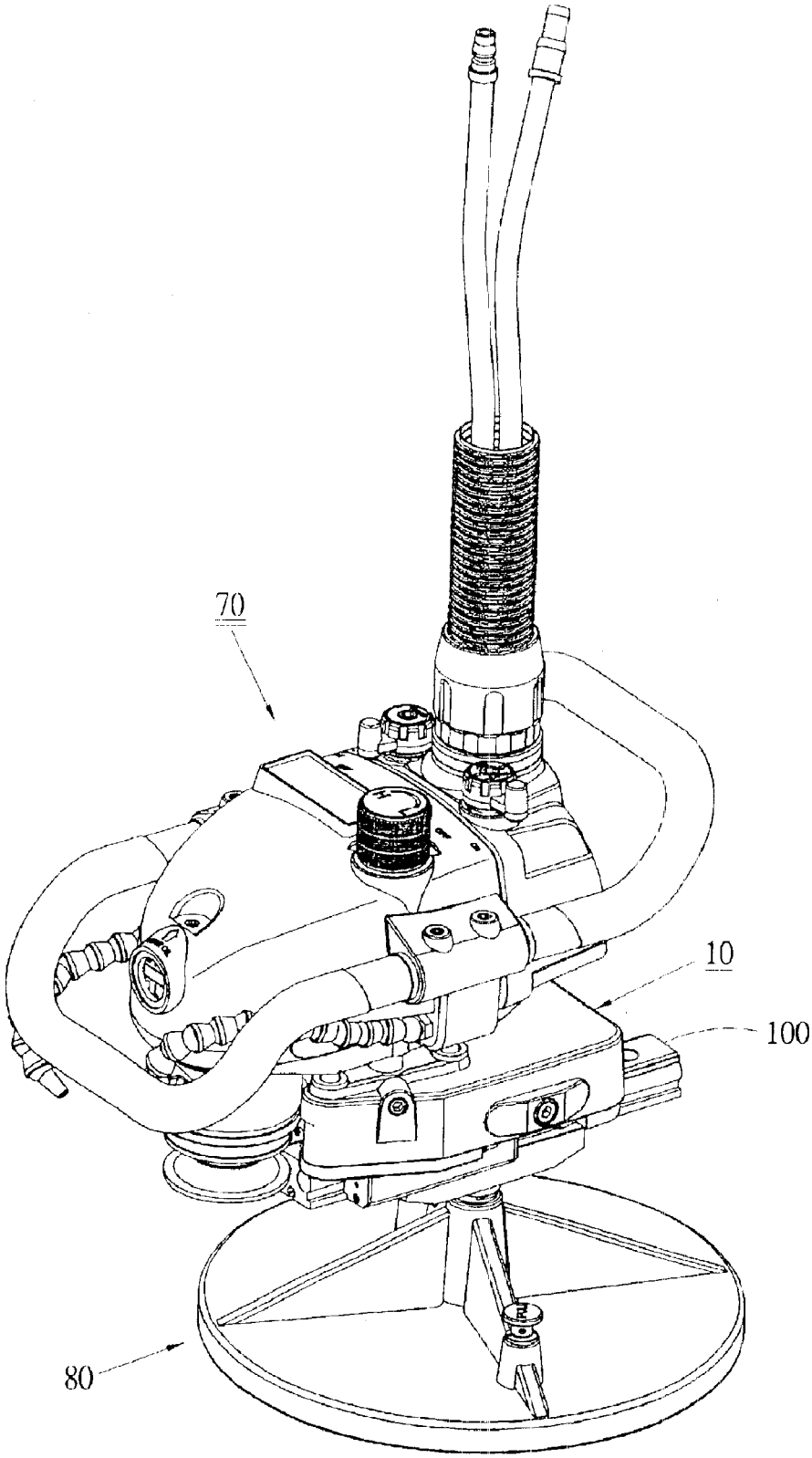
FIG. 9 shows the use of the present invention in another state.
Figure 10:
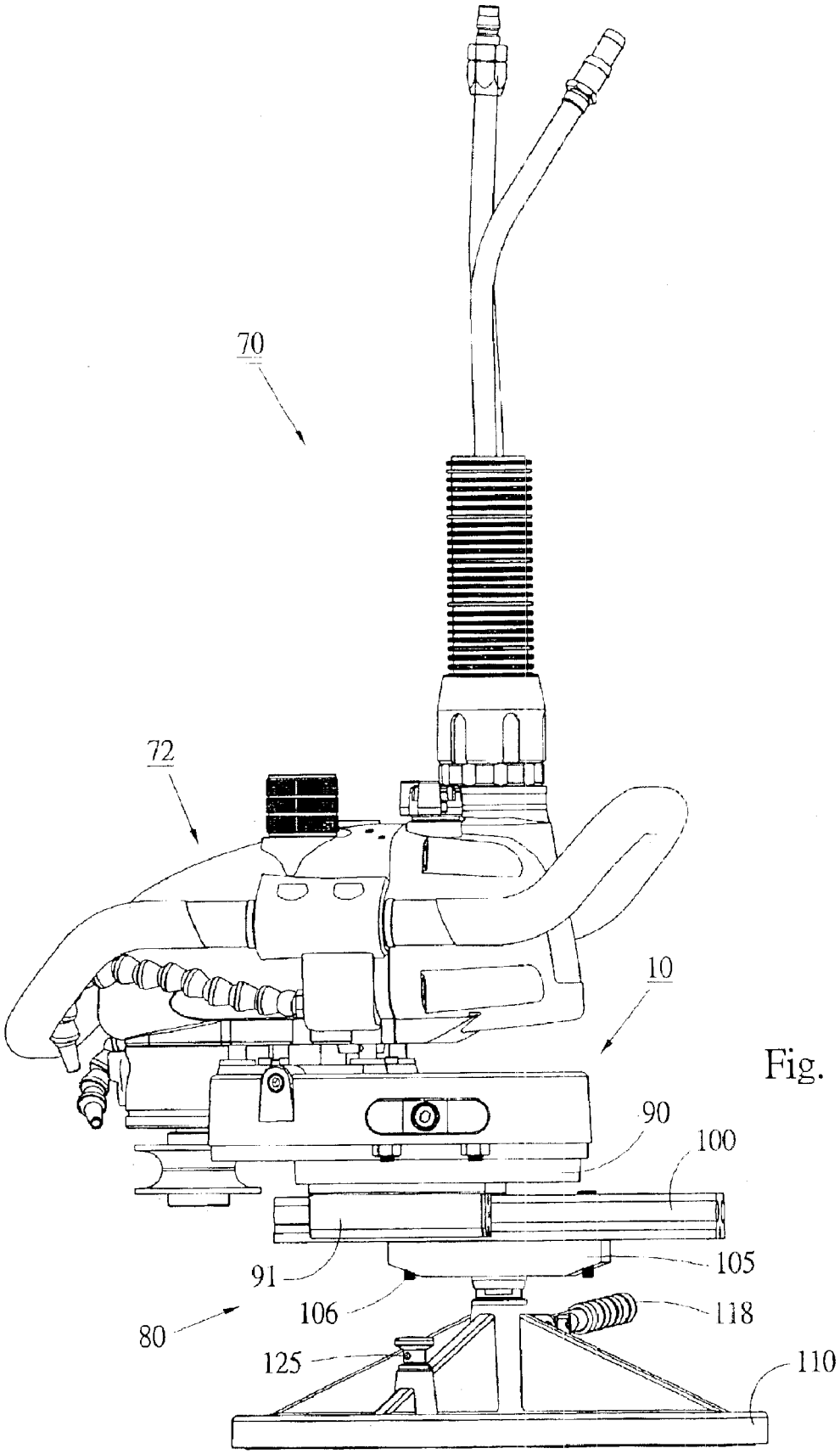
FIG. 10 is a side view according to FIG. 9.
Figure 11:
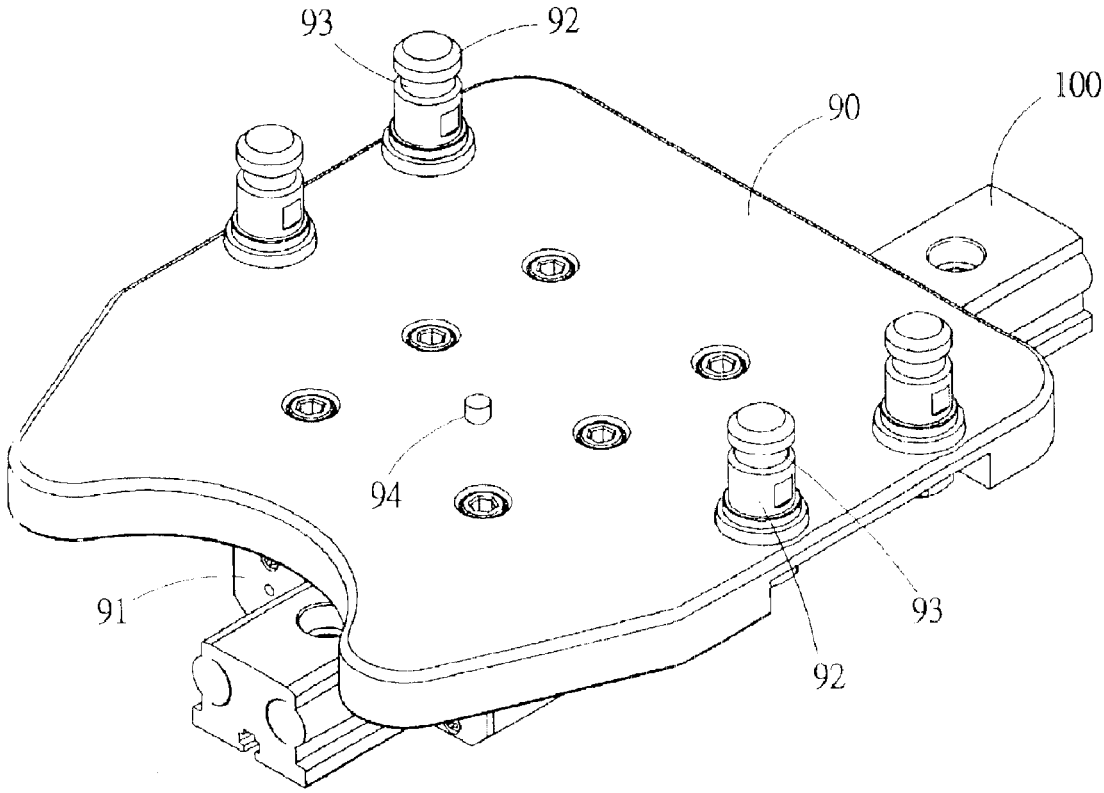
FIG. 11 is a perspective view of the support tray and slide rail of the bracket mechanism of the present invention.
Figure 12:
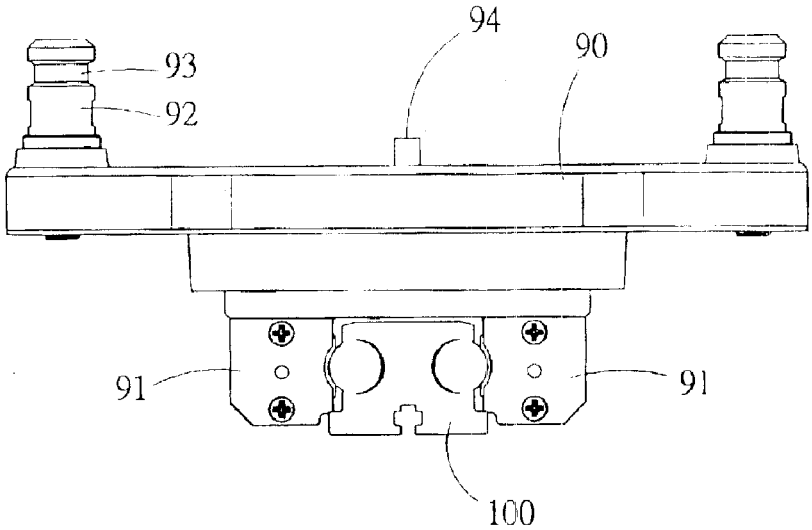
FIG. 12 is an end view according to FIG. 11.
Figure 13:
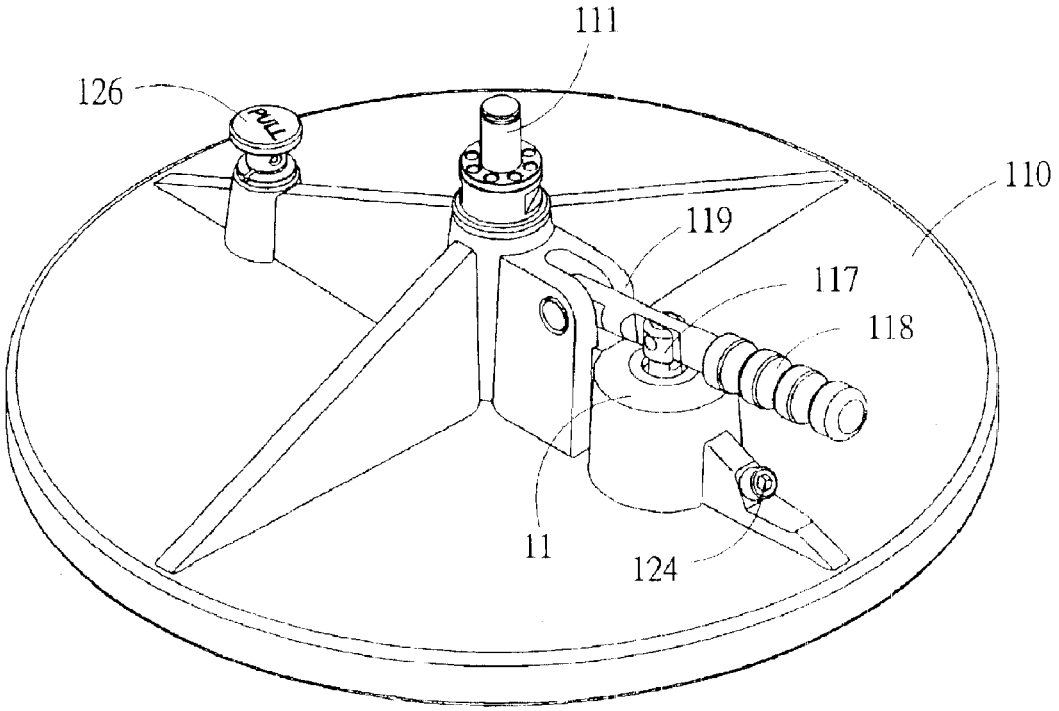
FIG. 13 is a perspective view of the base tray of the bracket mechanism of the present invention.
Figure 14:
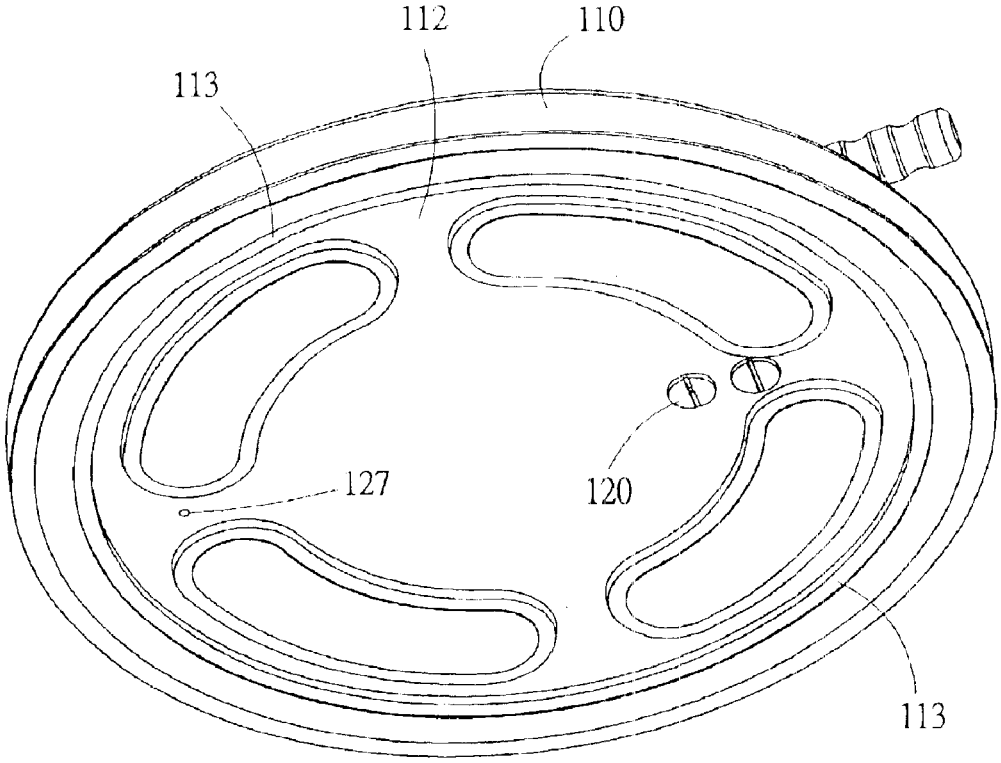
FIG. 14 is a bottom view according to FIG. 13.
Figure 15:
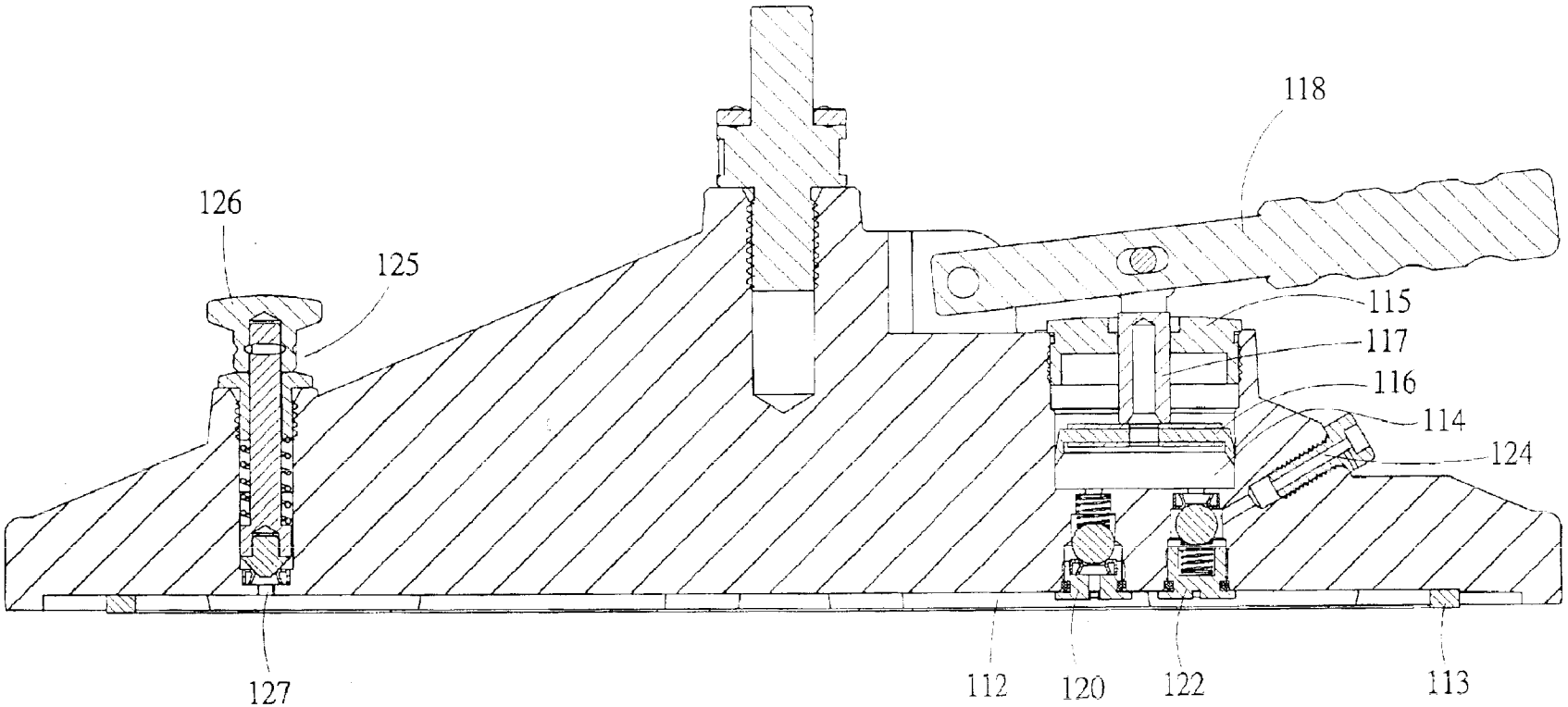
FIG. 15 is a longitudinal sectional view according to FIG. 13.
Figure 17:
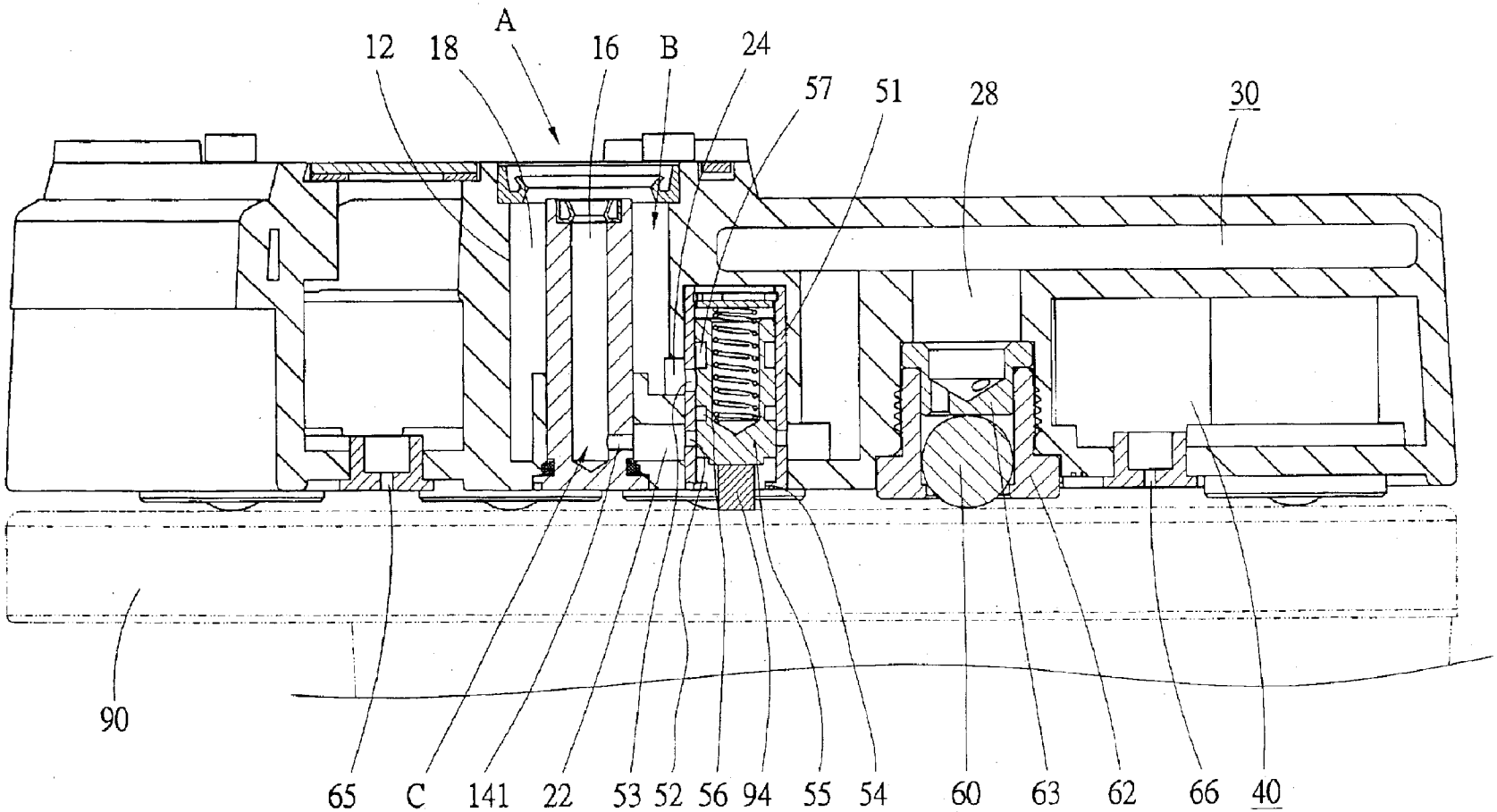
FIG. 17 shows that the base seat of the present invention is mounted on the bracket mechanism.

Referring to FIG. 9, the present invention further includes a bracket mechanism 80 including:

a support tray 90 as shown in FIG. 11, four insertion posts 92 being disposed on top face of the support tray 90, the insertion posts 92 being inserted in four insertion holes 29 formed on two sides of bottom face of the base seat 10 as shown in FIGS. 2 and 5, referring to FIG. 5, two lateral faces of the base seat being further formed with two dents 95 communicating with the edges of the two insertion holes 29 of the base seat, a slide block 96 being locked in each dent 95 by a screw 97, the slide blocks 96 serving to engage with recessed sections 93 of the insertion posts 92 to prevent the insertion posts 92 from being extracted out; an abutting post 94 being fixed on the top face of the support tray, referring to FIG. 17, the abutting post serving to extend through the perforation 54 of the bottom face of the base seat 10 to upward push the valve 55 of the controlling switch 50;

a slide rail 100, two parallel clamping blocks 91 being disposed on the bottom face of the support tray 90 to define an insertion channel, the slide rail 100 being inserted in the insertion channel as shown in FIGS. 11 and 12, whereby the support tray 90 can slide along the slide rail;

a connecting block 105 fixed on the bottom face of the slide rail 100 by two screws 106 as shown in FIG. 10, the bottom face of the connecting block 105 being formed with a shaft hole (not shown) in which a bearing is mounted; and a base tray 110 as shown in FIGS. 13 to 15, a depression 112 being formed on bottom face of the base tray 110, a gum ring 113 being disposed around the depression 112. On the base tray 110 are disposed:

a cylinder room 114 disposed on top face of the base tray and covered by a cylinder cover 115, a piston 116 being disposed in the cylinder room 114;

a lever 118, one end of the lever being pivotally connected with a lug 119 of the base tray, a lever body of the lever being connected with a piston rod 117 of the piston 116;

two one-way valves 120, 122 disposed in the base tray, the one-way valve 120 being an air inlet one-way valve communicating with the cylinder room 114 and the depression 112, whereby the air can only one-way flow from the depression to the cylinder room, the one-way valve 122 being an air outlet one-way valve communicating with the cylinder room 114 and an air outlet 124 formed on the base tray 110, whereby the air can only one-way flow from the cylinder room to the air outlet; and an air inlet valve 125 disposed in the base tray and communicating with the depression 112 and outer side, in normal state, the air inlet valve 125 keeping in an airtight state.

The bottom end of the connecting block 105 is formed with a shaft hole (not shown) for pivotally connecting the support tray 90 and the slide rail 100 with a pivot shaft 111 disposed at the center of top face of the base tray 110. FIGS. 9 and 10 show a state after installed.

Figure 16:
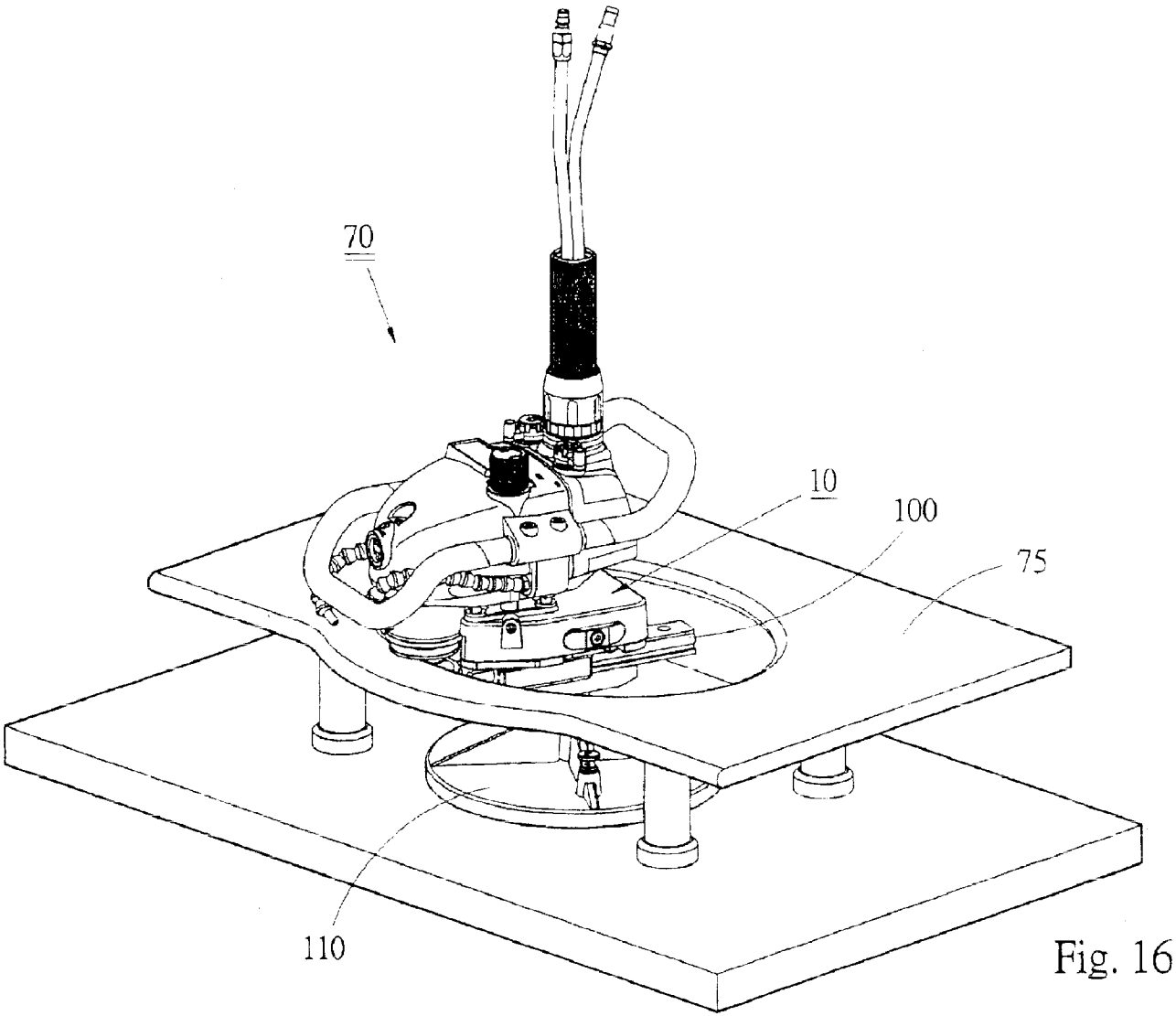
FIG. 16 shows a using state according to FIG. 9.

In use, as shown in FIG. 16, the grinder 70 is mounted on the bracket mechanism 80 and lifted. By means of linearly sliding the grinder along the slide rail 100 and rotating the grinder on the base tray 110, the grinder can be two-dimension moved to grind inner hole in the stone material.

When the base tray 110 is placed on the stone material, the gum ring 113 isolates the depression 112 from outer side. An operator can up and down shift the lever 118 to drive the piston 116 to reciprocally move within the cylinder room 115. When the piston is moved upward, the air is sucked from the depression through the air inlet one-way valve 120 into the cylinder room. When the piston is moved downward, the air in the cylinder room is exhausted from the air outlet 124. Accordingly, by means of repeatedly operating the lever, the depression is vacuumed, whereby the base tray sucks and locates on the stone material without moving.

When releasing the depression 112 from the vacuum, the pull button 126 of the air inlet valve 125 is pulled upward to release the air inlet valve from the airtight state. The atmosphere can flow through an orifice 127, as shown in FIG. 15, into the depression to balance the air pressure in the depression with the atmosphere.

Furthermore, referring to FIG. 17, when the base seat 10 is mounted on the support tray 90, the valve 55 of the controlling switch is pushed and displaced upward by the abutting post 94. Under such circumstance, the two flow conducting sections 56, 57 are both disaligned from the passage 22 and the tunnel 24 to shut off the air way B and water way C. Accordingly, both the high pressure air and the water will not be exhausted from the bottom face of the base seat.

When separating the base seat 10 from the support tray 90, the valve 55 is pushed by the spring 58 to restore to its home position as shown in FIG. 3 to re-free the air way and water way.

The pneumatic grinder has smaller volume and lighter weight than the conventional electric grinder. Most importantly, the high pressure air and the water are conducted to the bottom face of the base seat so as to reduce the frictional force against the base seat when moved. Therefore, the operation can be performed with less strength. Moreover, in the case that the bracket mechanism is added to the pneumatic grinder, the grinder can be two-dimension moved to grind inner hole of the stone material.

It should be noted that in the case that the bracket mechanism is omitted, it is unnecessary to dispose the controlling switch.

The above embodiments are only used to illustrate the present invention, not intended to limit the scope thereof. Many modifications of the above embodiments can be made without departing from the spirit of the present invention.

What is claimed is:

1. A base of a pneumatic grinder including a base seat comprising:

an air way located in the base seat, one end of the air way communicating with an outer side of the base seat for high pressure air to flow into the airway;

an air chamber located in the base seat; an inner end of the air way communicating with the air chamber;

a predetermined number of air rooms located in the base seat at intervals, a bottom end of each the air room communicating with the bottom face of the base seat, an interior of the air room communicating with the air chamber; and a plurality of ball bodies, one of the plurality of ball bodies being rollably located in each of the air rooms, a bottom edge of the ball bodies protruding from the bottom face of the base seat.

2. The base according to claim 1, further comprising a controlling switch including a valve formed with a flow conducting section, the valve being located in the base seat and being connected with the air way, the valve being movable between open and closed positions, wherein, in the open position, the flow conducting section communicates with the air way and in the closed position, the flow conducting section is separated from the air way.

3. The base according to claim 1, further comprising a bracket mechanism including:

a support tray, the base seat being connected to a top face of the support tray;

a slide rail, a bottom face of the support tray being mounted on the slide rail, the support tray is slidable along the slide rail; and a base tray, a bottom face of the slide rail being pivotally connected with a top face of the base tray via a pivot shaft, the support tray and the slide rail are rotatable on the base tray.

4. A base of a pneumatic grinder including a base seat comprising:

a water way located in the base seat, one end of the water way communicating with an outer side of the base seat for water to flow into the water way;

a water chamber located in the base seat; an inner end of the water way communicating with the water chamber;

a predetermined number of water outlets located on a bottom wall of the water chamber, the water outlets passing downwardly through the bottom wall to a bottom face of the base seat; and a controlling switch including a valve formed with a flow conducting section, the valve being located in the base seat and being connected with the water way, the valve being movable between open and closed positions, wherein, in the open position, the flow conducting section communicates with the water way, and in the closed position, the flow conducting section is separated from the water way.

5. A base of a pneumatic grinder having a base seat comprising:

an air way located in the base seat, one end of the air way communicating with an outer side of the base seat;

an air chamber located in the base seat; an inner end of the air way communicating with the air chamber;

a predetermined number of air rooms located in the base seat at intervals, a bottom end of each the air room communicating with the bottom face of the base seat, an interior of the air room communicating with the air chamber;

a plurality of ball bodies a number of which are equal to the number of the air rooms, one of the plurality of ball bodies being rollably located in each of the air rooms, a bottom edge of the ball bodies protruding from the bottom face of the base seat;

a water way located in the base seat, one end of the water way communicating with an outer side of the base seat;

a water chamber located in the base seat, an inner end of the water chamber communicating with the water way; and a predetermined number of water outlets disposed on bottom wall of the water chamber, the water outlets downward passing through the bottom wall to the bottom face of the base seat.

6. The base according to claim 5, wherein an inlet is formed on the circumference of the base seat for the fluid to flow into the base seat, outer ends of the air way and water way being concentrically located at the inlet.

7. The base according to claim 6, wherein the base seat is recessed to form a hole in the position of the inlet, an inner tube being coaxially located in the hole, an interior of the hole and an interior of the inner tube respectively forming two independent flow ways as outer end of the air way and outer end of the water way.

8. The base according to claim 5, further comprising a controlling switch including a valve formed with two flow conducting sections, the valve being located in the base seat and being connected with the air way and water way, the valve being operable to move within the base seat to make the two flow conducting sections respectively communicate with the air way and waterway or make the flow conducting sections not communicate with the air way and water way.

9. The base according to claim 8, further comprising a cavity formed on the bottom face of the base seat, the air way and water way both passing through the cavity, the valve being located in the cavity.

10. The base according to claim 9, wherein the bottom face of the base seat having a perforation at bottom end of the cavity; the controlling switch further including a resilient member located in the cavity for pushing the valve, whereby in normal state, the valve is kept at a lower dead end, the bottom end of the valve being positioned at the perforation, the two flow conducting sections respectively communicating with the air way and water way.

11. The base according to claim 10, wherein the controlling switch further comprising a barrel, a circumference of the barrel being formed with two through holes, the perforation being formed on bottom face of the barrel, the barrel being located in the cavity, the two through holes respectively communicating with the air way and water way, the valve being mounted in the barrel, the perforation being located on the bottom face of the base seat; whereby when the valve is positioned at the lower dead end, the bottom end of the valve is located at the bottom end of the barrel.

12. The base according to claim 10, further comprising a bracket mechanism including:

a support tray, an abutting post being disposed on a top face of the support tray, the base seat being connected with the top face of the support tray, the abutting post extending into the perforation for upward pushing the valve of the controlling switch to shut off the air way and water way;

a slide rail, a bottom face of the support tray being mounted on the slide rail, the support tray is slidable along the slide rail; and a base tray, a bottom face of the slide rail being pivotally connected with top face of the base tray via a pivot shaft, the support tray and the slide rail are rotatable on the base tray.

13. The base according to claim 12, wherein a plurality of insertion holes are formed on the bottom face of the base seat; a plurality of insertion posts are located on the top face of the support tray, one of the plurality of insertion posts is inserted into each of the plurality of insertion holes.

14. The base according to claim 13, wherein at least one lateral side of the base seat is formed with a dent communicating with the edge of at least one insertion hole, at least one slide block being locked in each the dent by a screwed member, at least one insertion post of the plurality of insertion posts of the support tray being formed with a recessed section, whereby an inner side of the slide block can be engaged with the recessed section.

15. The base according to claim 12, wherein the bottom face of the support tray is formed with an insertion channel in which the slide rail is inserted.

16. The base according to claim 12, wherein the bracket mechanism further includes a connecting block fixed on the bottom face of the slide rail, bottom face of the connecting block being pivotally connected with the top face of the base tray via a pivot shaft.

17. The base according to claim 12, wherein a depression is formed on bottom face of the base tray, an annular airtight member being located around the depression, an air outlet being located in the base tray communicate with outer side; further comprising:

a cylinder room located on top face of the base tray;

a piston movably located in the cylinder room, a piston rod of the piston protruding upwardly from the cylinder room;

a lever, one end of the lever being pivotally connected with the base tray, a lever body of the lever being connected with the piston rod;

an air inlet one-way valve and an air outlet one-way valve located in the base tray, the air inlet one-way valve communicating with the cylinder room and the depression, whereby the air has a first one-way flow from the depression to the cylinder room; the air outlet one-way valve communicating with the cylinder room and the air outlet, the air has a second one-way flow from the cylinder room to the air outlet; and an air inlet valve located in the base tray and communicating with the depression and outer side, permitting the atmosphere to flow from outer side into the depression, in a normal state, the air inlet valve is in an airtight state.

18. The base according to claim 5, wherein a spacer ring and a hollow locating member are located in each air room, the locating member being positioned under the spacer ring, the spacer ring being formed with several orifices passing through the spacer ring from top face to bottom face thereof, each of the plurality of ball bodies being positioned between the locating member and the spacer ring.

19. The base according to claim 5, further comprising a bracket mechanism including:

a support tray, the base seat being connected with top face of the support tray;

a slide rail, a bottom face of the support tray being mounted on the slide rail, whereby the support tray is slidable along the side rail; and a base tray, a bottom face of the slide rail being pivotally connected with top face of the base tray via a pivot shaft, wherein the support tray and the slide rail are rotatable on the base tray.

20. A base of a pneumatic grinder including a base seat comprising:

a water way located in the base seat, one end of the water way communicating with an outer side of the base seat for water to flow into the water way;

a water chamber located in the base seat; an inner end of the water way communicating with the water chamber;

a predetermined number of water outlets located on a bottom wall of the water chamber, the water outlets passing downwardly through the bottom wall to a bottom face of the base seat; and a bracket mechanism including:

a support tray, the base seat being connected with a top face of the support tray;

a slide rail, a bottom face of the support tray being mounted on the slide rail, the support tray is slidable along the slide rail; and a base tray, a bottom face of the slide rail being pivotally connected with a top face of the base tray via a pivot shaft, the support tray and the slide rail are rotatable on the base tray.

* * * * *